US005513477A

United States Patent [19]

Farber

[11] Patent Number: 5,513,477

[45] Date of Patent: May 7, 1996

[54] SEGMENTED, GRADED STRUCTURAL UTILITY POLES

[75] Inventor: Milton L. Farber, Santa Ana, Calif.

[73] Assignee: International Composites Systems, LLC, Pasadena, Calif.

[21] Appl. No.: 395,849

[22] Filed: Feb. 28, 1995

[51] Int. Cl.[6] ..... E04H 12/12

[52] U.S. Cl. ..... 52/726.4; 52/730.4; 52/723.1; 52/736.3

[58] Field of Search ..... 52/726.4, 727, 52/728, 730.4, 723

[56] References Cited

U.S. PATENT DOCUMENTS

| | | | |
|---|---|---|---|
| Re. 17,834 | 10/1930 | De Witt | 52/726.4 X |
| 122,656 | 1/1872 | Rogers | 52/726.4 |
| 232,360 | 9/1880 | Milliken | 52/726.4 |
| 2,834,073 | 5/1958 | Hoyle, Jr. | 52/726.4 |
| 3,031,041 | 4/1962 | Pfaff, Jr. | 52/726.4 X |
| 3,034,209 | 5/1962 | Bianca et al. | 52/726.4 X |
| 3,713,262 | 1/1973 | Jatcko | 52/726.4 X |
| 3,787,268 | 1/1974 | Scott et al. . | |
| 3,865,498 | 2/1975 | Okuto et al. | 52/726.4 X |
| 3,929,543 | 12/1975 | Scott et al. . | |
| 4,244,156 | 1/1981 | Watts, Jr. . | |
| 4,251,036 | 2/1981 | McLain . | |
| 4,283,446 | 8/1981 | McLain . | |
| 4,312,162 | 1/1982 | Medney . | |
| 4,355,061 | 10/1982 | Zeigler . | |
| 4,433,933 | 2/1984 | Parsons, Jr. et al. . | |
| 4,697,649 | 10/1987 | Kinnan . | |
| 4,769,967 | 9/1988 | Bourrieres . | |
| 4,803,819 | 2/1989 | Kelsey . | |
| 4,813,199 | 3/1989 | Lewis, Jr. . | |
| 4,878,984 | 11/1989 | Bourrieres . | |
| 5,060,437 | 10/1991 | Parsons et al. . | |
| 5,117,607 | 6/1992 | Bourdon | 52/726.4 X |
| 5,197,253 | 3/1993 | Johnson . | |
| 5,197,818 | 3/1993 | Johnson . | |
| 5,222,344 | 6/1993 | Johnson . | |
| 5,247,774 | 9/1993 | Johnson . | |
| 5,251,420 | 10/1993 | Johnson . | |
| 5,285,612 | 2/1994 | Johnson . | |
| 5,285,613 | 2/1994 | Goldsworthy . | |
| 5,285,614 | 2/1994 | Fouad | 52/726.4 |
| 5,319,901 | 6/1994 | Goldsworthy et al. . | |

*Primary Examiner*—Carl D. Friedman
*Assistant Examiner*—Wynn E. Wood
*Attorney, Agent, or Firm*—Knobbe, Martens, Olson & Bear

[57] ABSTRACT

A segmented, graded structural pole of composite construction is provided for supporting utility lines. The structural pole comprises graded pre-molded external segments which are shaped to form an external structure when attached to one another. Due to the pre-molded nature of the segments, the resultant pole is capable of supporting utility lines at heights much greater than prior poles. Further, the pole may include one or more internal members attached to the hollow interior of the external structure. A variety of external segments and internal members may be combined in modular fashion for quick on-site assembly of structural poles which are tailored to specific height and strength requirements.

44 Claims, 8 Drawing Sheets

SEGMENTED, GRADED STRUCTURAL UTILITY POLES

BACKGROUND OF THE INVENTION

1. Field of the Invention

This invention relates generally to structural poles, and more particularly to composite poles for supporting utility lines.

2. Description of Related Art

Utility lines, such as those carrying electrical power, cable television signals or telephone signals, have traditionally been supported above ground using wooden poles. Trees suitable for use as utility poles, however, have become less available, especially at lengths required for electrical transmission (45 to 120 feet). Because wood is susceptible to insect infestation and rot, it is necessary to constantly replace older wooden poles. The demand for replacement poles, in combination with the demand for new poles, has become increasingly difficult to meet and presents environmental concerns related to deforestation.

Wooden poles pose further environmental hazards. Preservatives such as creosote, used to prevent rot and insect infestation in wooden poles, can seep into groundwater. Environmental groups and the Environmental Protection Agency thus oppose the use of new wooden poles to replace older ones.

Alternative materials have been used in response to the decreasing supply of trees, but these alternatives suffer from their own disadvantages. Metal and concrete poles, for example, are heavy and bulky and therefore difficult to transport or store. The conductivity of metal poles risks arcing between phases, making such poles dangerous to utility personnel servicing lines and necessitating costly methods of insulation. Temperature fluctuations, moisture and salt all cause considerable corrosion to or erosion of these materials.

More recently, fiber/resin composite poles (for example, polyester resin reinforced by glass strands) have been developed to address many shortcomings of metal and concrete poles. Such composite poles are nonconductive, resistant to corrosion and erosion, and are environmentally friendly. Composite poles, however, have not been available at longer lengths for transmission of electrical power and other signals. Current practitioners who are well-versed in state-of-the-art composite tube design and fabrication have found that their designs and processes are restricted to lengths of approximately 45 feet or less. They employ three basic manufacturing approaches.

One approach is to utilize a constant diameter, pultruded shape as a pole. This type of structure is satisfactory for relatively short poles up to approximately 35 feet with diameters of approximately 10 inches. Poles of longer lengths and heavier loading require longer diameters and thicker walls to withstand increased stresses encountered at the base of the pole. For example, a nontapered geometry of a 55-foot pole would require a minimum ground level diameter of 16 inches for a medium-duty pole. End-users resist poles in excess of 10 inches diameter at the top where attachments are made. A pultruded composite pole thus could not be made in accordance with this approach and meet the requirements of the end-user.

A second approach encompasses variations of filament winding techniques with fibers and resins applied about a tapered mandrel. Even though the mandrel is supported at both ends, the combined weight of the mandrel and fiber/resin causes the mandrel to deflect, resulting in bowed or curved portions of the pole when cured and removed from the mandrel. The liquescent nature of the resin precludes supporting the center section during curing. Maximum acceptable bowing restricts the use of this process to producing poles of approximately 45 feet.

A third process attempted involves filament winding additional fiber/resin around pre-existing pultruded tubes. Bowing at cure, described above, also limits the length of pole produced by this process to approximately 45 feet. Thus, fiber/resin poles have not been commercially available at longer lengths suitable for support of electrical transmission lines.

Moreover, a deficiency common to all of the above poles, including traditional wooden poles, is the long lead time required to obtain poles of the required specification and the costs entailed by that delay. Utility carriers have developed exacting structural requirements, tailoring pole specifications for differences in line direction, terrain profile, soil composition, span length, wind velocity, safety needs, degree of insulation and other operationally and environmentally determined factors. With such a variety of specifications, it is very expensive for users to maintain a sufficient inventory of poles to meet unpredictable demand for replacement poles, which demand might result from a storm, for example. High cost of lost revenues from downed lines prohibits waiting for the manufacturer to build poles to specification.

SUMMARY OF THE INVENTION

One aspect of the present invention provides a composite utility pole of graded thickness assembled from pre-existing module components. The individual components desirably are selected to tailor the characteristics of the pole (i.e., strength, flexibility, length) to a specific application. The pole comprises graded vertical segments, which are attached to one another at their side faces, forming an external structure extending along at least a portion of the resultant pole's vertical axis. The outer faces of the external segments cooperate to form the external structure's outer surface, which has a closed horizontal cross-sectional shape through which the perpendicular pole axis passes.

A fiber/resin composite pole so comprised is capable of reaching heights up to 120 feet, due to the fact that the pre-existing segments may be supported and do not experience deflection during assembly. The external segments are preferably tapered from a thick bottom to a thinner top, so that the pole can withstand stresses as they change along the length of a cantilever-mounted utility pole. Furthermore, fiber orientation within the external segments may be arranged to provide varying amounts of hoop strength and stiffness at different points of the pole. In a preferred embodiment, the external structure has a hollow core and is also capable of joining together multiple internal members, each attached to the interior surface of the hollow external structure.

Another aspect of the present invention provides a pole comprising at least one internal member and at least two independent, pre-existing external segments of fiber/resin composition. The external segments reinforce the internal member by forming a reinforcing external structure which surrounds a length of the internal member, allowing the pole to withstand stresses common to utility poles. In a preferred embodiment, the internal member comprises a pultruded composite tube formed of mostly axially oriented fibers, giving the pole sufficient bending stiffness along its length. The external reinforcement, in the form of external segments, may contribute hoop strength as well as stiffness to the pole.

In accordance with a further aspect of the present invention, a method of manufacturing a structural utility pole involves pre-molding external segments in shapes which, when assembled, form a vertical, elongated tapered external structure surrounding a hollow core. The segments comprise fiber/resin material. Because the tapered external segments are pre-molded, no deflection occurs during resin cure, making it possible to create poles longer than those of the past.

In accordance with a method of assembling a structural utility pole, external segments are provided with a variety of structural characteristics. The method also involves selecting a desired structural specification for the pole to be assembled, and selecting the external segments which will produce an external structure with structural characteristics corresponding to the desired specification.

According to a preferred embodiment, one or more internal members may also be included in the assembly, depending upon structural needs. This method of assembly results in a modular design with which manufacturers or end users may quickly assemble a great variety of poles from a relatively small variety of inventoried modules.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF THE PREFERRED EMBODIMENT

Figure 1:
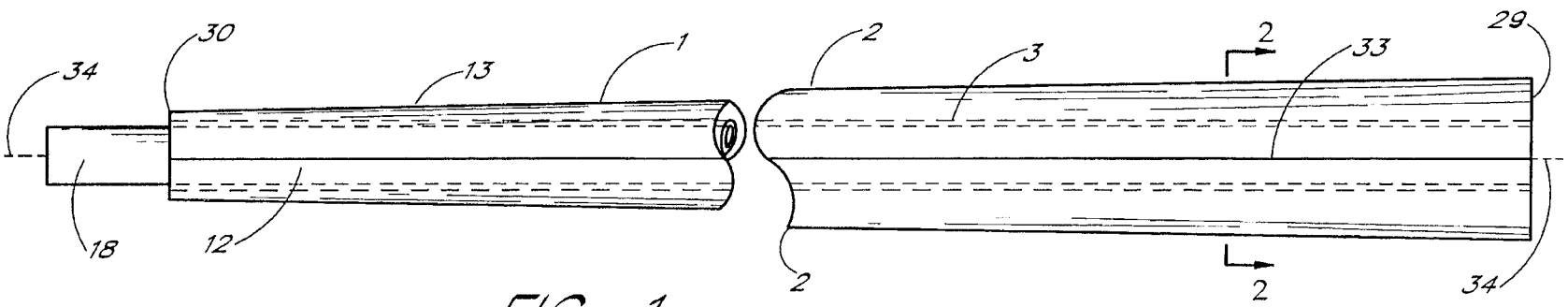
FIG. 1 is a side elevational view of a graded structural utility pole constructed in accordance with a preferred embodiment of the invention.

FIG. 1 illustrates a segmented, graded structural pole 1 which is configured in accordance with a preferred embodiment of the present invention. The structural pole 1 is adapted to supporting utility lines (not shown) such as cables carrying electrical energy, telephone signals, or television signals. Although the cross-section of the pole 1 is circular, as best understood from FIG. 2, the cross-section may equally well be square, triangular, or any other geometric shape suited to withstand stresses experienced in end use. For purposes of illustration, however, the drawings and description focus on round poles.

It is preferred that the pole 1 be constructed of a fiber/resin composite or other lightweight, nonconductive structural material (e.g., plastics). The advantages of using such materials in utility poles, as noted in the background section above, are well known. Unlike previous fiber/resin poles, though, the present pole allows for the construction of fiber/resin structural poles at lengths not previously achieved, leading to expanded uses, and comprises a modular construction which permits on-site assembly of tailored structural poles.

Figure 2:
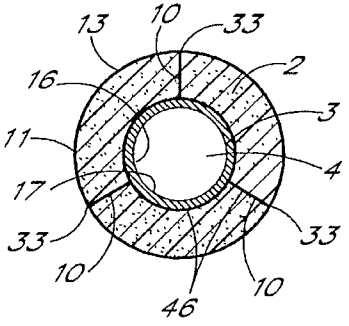
FIG. 2 is a cross-sectional view of the structural utility pole of FIG. 1, taken along line 2—2.

Referring now to FIGS. 1 and 2, a preferred embodiment of the pole 1 is assembled from independent, pre-existing external segments 2 which may attach to and surround an internal member 3. The external segments 2 thus reinforce the internal member 3, which desirably comprises a hollow inner tube 3. It should be understood, however, that the internal member can have different configurations as well in order to suit a specific application. The length and wall thickness of an inner tube may vary according to the strength and stiffness desired of the pole. For example, a thin-walled inner tube 3 may be longer than the external segments 2 when it is desirable to minimize weight near the top of a tall pole 1. However, when strength is important even at the top of the pole, the pole may be configured with external segments coextensive with the internal member.

The internal member 3 desirably is hollow with a minimal wall thickness in order to minimize the weight of the pole 1. At the same time, the wall of the internal member 3 must be sufficiently thick to produce a structurally sound pole 1, with stiffness and strength to prevent significant bending or inward collapse of the external segments 2.

Similarly, a balance must be struck in selecting the width (or diameter) of the internal member 3. A tube 3 with an extremely wide diameter and an appropriate wall thickness will produce too heavy a pole 1, due to both the weight of the tube 3 itself and the additional weight of the external segments 2 which reinforce it. On the other hand, the tube must be sufficiently wide to provide the pole 1 stability and a proper degree of stiffness. The larger the width (e.g., diameter) of the internal member 3 the larger, the moment of inertia of the internal member 3. The internal member 3 thus becomes stiffer with an increase in its width (e.g., diameter).

The internal member 3 also should have a width selected to conform to the specifications of the end user. For instance, when the pole 1 is used to support electrical transmission lines, the internal member 3 desirably has a width (e.g., diameter) of about 10 inches at its top to meet the conventional requirements of the end user.

Internal members 3 of the required length can be produced by known processes. A one-piece internal member 3 is preferably created by automated pultrusion, although more expensive processes such as filament winding and hand lay-up are also acceptable. In the alternative, a number of internal members 3 can be joined together in the manner described in connection with the embodiments illustrated by FIGS. 9 and 10.

Figure 3:
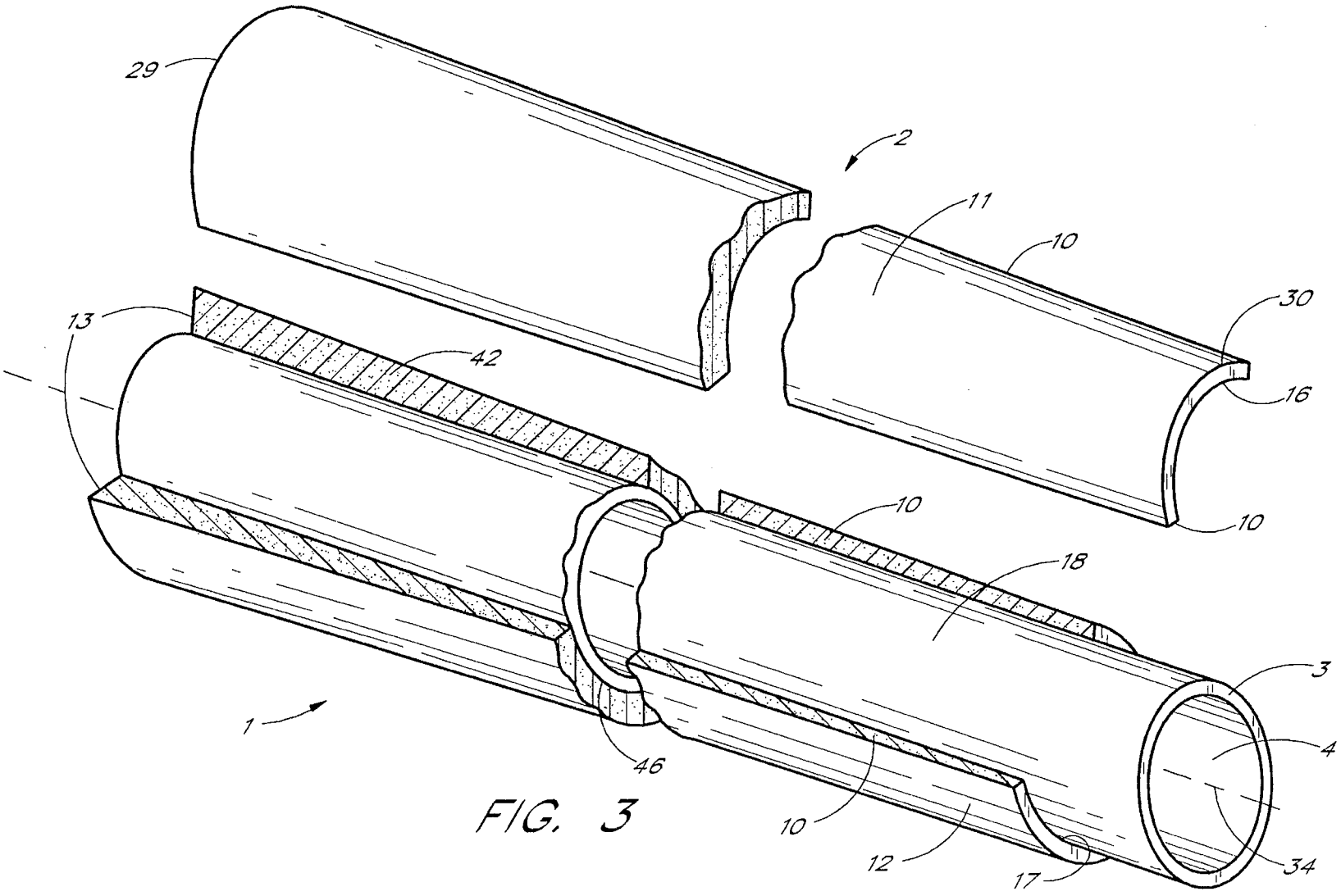
FIG. 3 is a partially exploded perspective view of the structural utility pole of FIG. 1 with two external segments attached to an internal member and a third external segment unattached.

With reference to FIGS. 1 to 3, all external segments 2 of one pole 1 desirably have the same shape to simplify their manufacture. The shape of each external segment 2 is chosen such that when the pole 1 is assembled, the side faces 10 of the segments 2 abut one another and the outer faces 11 of the segments 2 meet to form the smooth outer surface 12 of a resulting external structure 13. To produce the round poles illustrated in all the drawings, the outer faces 11 of the external segments 2 desirably have a convex shape to give the outer surface 12 a circular periphery. Although three segments 2 are depicted in the drawings, each segment 2 representing a 120° arc along the circumference of the pole 1 to form a tapered cylinder, it will be understood that any number of segments, two or more, will function equally well. For example, there may be four segments representing 90° arcs along the circumference. Preferably, the assembled pole will have a hollow core 4, as shown, resulting in lightweight construction.

External segments 2 are preferably of varying thickness along their length, corresponding to the varying stresses experienced along the length of the pole 1. The illustrated external segments 2, for example, taper in thickness and arc length at a constant rate. The outer surface 12 of the external structure 13, formed by the segments 2 thus desirably resembles a conical surface in three dimensions, the external structure 13 tapering in outside circumference as well as thickness (see the changing thickness of the side face 10 in FIG. 3).

Each external segment 2 may also have an inner face 16, which in the illustrated embodiment has a convex shape. The radius of curvature of the inner face 16 desirably matches that of the outer surface 18 of the inner tube 3. As a result, the external segments 2 cooperate with one another to form a constant cross-sectional cylindrical inner surface 17 of the external structure 13 which desirably matches the outer surface 18 of an internal member 3. The cross-sectional geometries of the external structure 13 and the internal member 3, however, can vary without detracting from the essence of the present structural pole 1.

Figure 11:
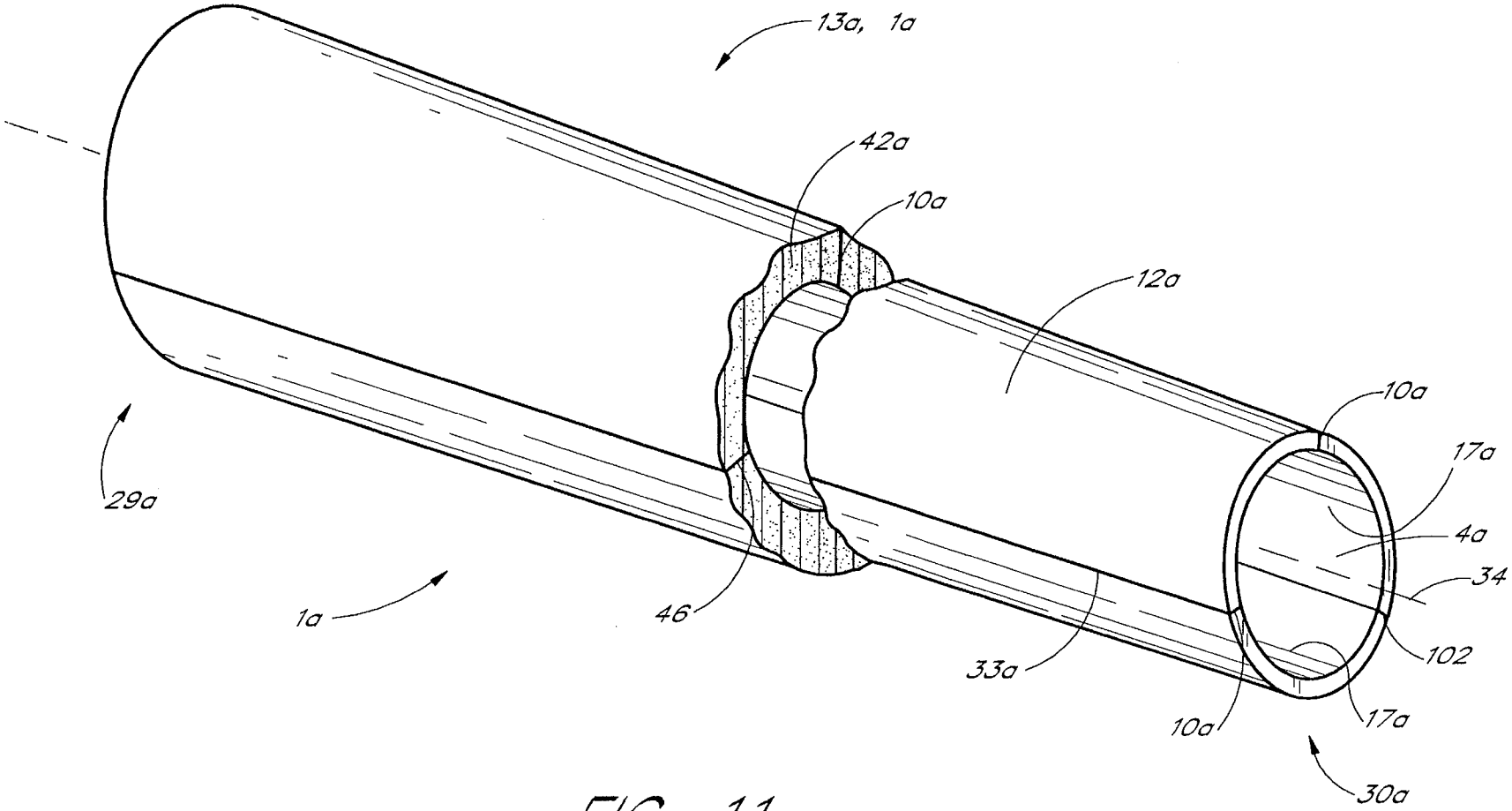
FIG. 11 is a perspective view of a graded structural utility pole constructed in accordance with another preferred embodiment of the present invention, comprising an external structure without an internal member.

In the illustrated embodiment, the external structure 13 is assembled about and reinforces the internal member 3. It is contemplated, however, that in the alternative, the external structure can represent the entire pole, as illustrated by the embodiment of FIG. 11. The reader will understand that the pole 1*a* of FIG. 11 need not have any particular contour to its inner surface 17*a* because it does not cooperate with an internal member. FIG. 11 is further discussed below.

Figure 4:
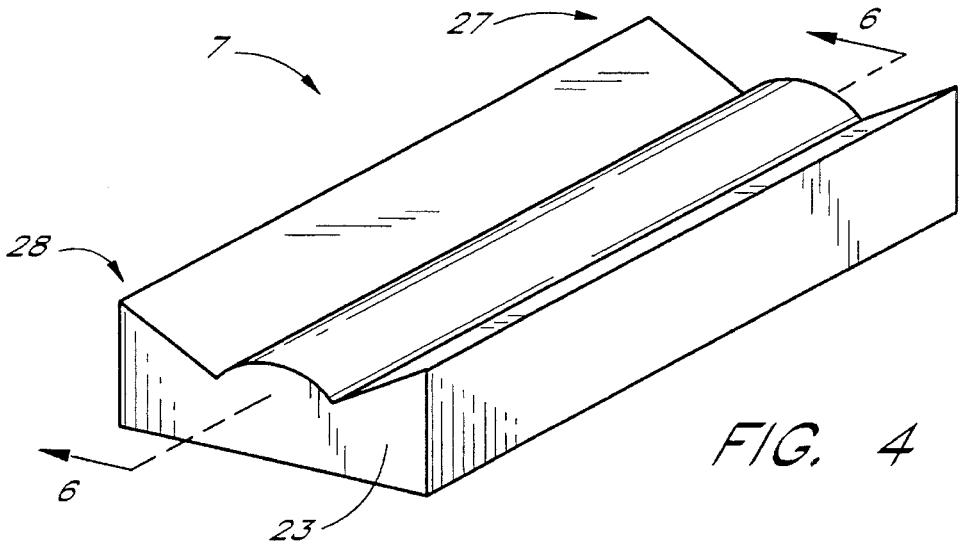
FIG. 4 is a perspective view of a male tooling used for molding external segments of the structural utility pole of FIG. 1.
Figure 5:
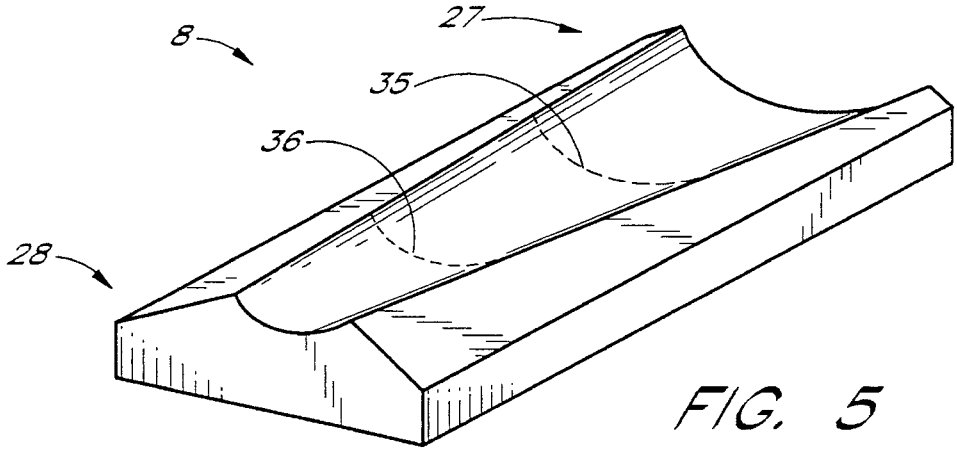
FIG. 5 is a perspective view of a female tooling used for molding external segments of the structural utility pole of FIG. 1.
Figure 6:
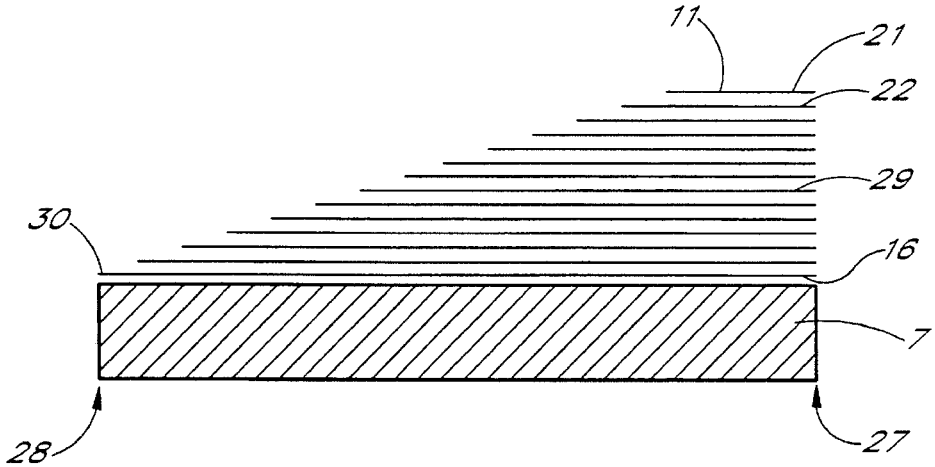
FIG. 6 is a cross-sectional view of the male tooling of FIG. 4 taken along line 6—6, schematically illustrating layers of fiber and resin laid stepwise over the tooling.

The external segments 2 are pre-molded and cured, preferably in an open mold comprising one of two rigid pieces of tooling 7, 8, shown in FIGS. 4 to 6. In describing the process of molding an external segment, reference will be made to both the toolings (FIGS. 4 to 6) and the end product (FIGS. 1 to 3).

With reference initially to FIGS. 4 and 6, reinforcing fibers 21 may be laid over a male tooling 7 (convex, for the exemplar round poles) and bound together by a resin matrix 22. The configuration of the male tooling 7 determines the contour of each external segment's inner face 16. For the illustrated pole of FIG. 1, the male tooling 7 has a constant cross-section in order for the inner face 16 of the external segment 2 to mate with a uniform cross-section inner tube 3. Alternatively, the male tooling may be partially or fully tapered, depending upon the shape of the internal member, if any, which is to be bonded to the inner surface 17 of the external structure 13. (Another preferred embodiment illustrated in FIG. 11, for example, does not include an internal member, and as such, the inner surface 17*a* of the pole 1*a* need not be cylindrical and in fact the pole 1*a* would be even lighter if the inner surface 17*a* tapered parallel (or nearly parallel) with the outer surface 12*a*.)

The side faces 10 conform to the angled projections 23 of the male tooling 7. For the embodiments illustrated, the projections 23 are positioned at 120° to one another, such that three external segments 2 bonded at the side faces 10 will form an enclosed cross-section. If four segments are desired, manufacturers may employ a tooling with side projections at 90° to one another.

It is necessary to trim the plies of glass 21 at correct widths before positioning the plies 21 on either the male mold 7 or the female mold 8 if the segments 2 are to be assembled "as molded." That is, the plies of glass 21 will be trapezoidal to match the prescribed taper in the arc length along the length of the segment 2.

An alternative and equally acceptable method of achieving exact radial angle at the edges of the segment 2 is to increase the mold arc length to allow nontapered plies of glass to lay beyond the area of the projection. This obviates trimming of the plies to trapezoidal patterns and simplifies lay-out of the plies 21. The cured segments are subsequently trimmed by sawing with a conventional diamond saw or by cutting with high-pressure water jets to the exact desired angle.

A female tooling 8, as illustrated in FIG. 5, may be used in place of a male tooling 7 to mold the external segments 2. The configuration of the female tooling 8 determines the contour of each external segment's outer face 11. FIG. 5 illustrates a mold 8 which produces segments with tapered arc lengths. If the external segments 2 must mate with a constant-section inner tubes 3, such as illustrated in FIG. 3, the layers of fiber should be carefully arranged to ensure that the inner face 16, which faces upward in an open female open mold 8, is contoured to match the internal member 3. Furthermore, the thickness of the segments 2 may also be tapered by controlling the relative number of fiber layers 21 laid at the bottom and top ends of the female mold 8.

FIG. 6 schematically illustrates how a segment 2 with a tapering thickness may be shaped by laying fibers 21, such as glass cloth, and resin matrix 22 on the male tooling 7 in step fashion. For example, the lowest layers (i.e., the layers of the external segment 2 closest to the inner face 16) can extend the length of the tooling 7 and higher layers would comprise continually shorter fibers 21 which start at the bottom 27 of the tooling and extend short of the top 28. The external segment 2 would thus be thicker and have greater outside arc length near the bottom 29 than at the top 30 of the segment 2. It will be understood that a similar process of laying up fibers 21 may be used to create a tapered external segment 2 in the female tooling 8. Where the male tooling 7 precisely shapes the inner face 16 of external segments 2, the female tooling 8 is more useful in shaping the outer face 11 of the segments 2, resulting in a smoother outer surface 12 of the external segment 2, with barely detectable seams 33. It will be understood that step layering may also be achieved by the reverse positioning of long and short layers.

FIG. 6 also schematically illustrates the spacing between layers of fiber 21 in an exaggerated form. In reality, the fibers 21 impregnated or wetted with resin would lie closer to one another.

It is not necessary that the plies of fibers 21 be continuous from one end of the segment 2 to the other. In the interest of material cost savings, the wider width fiber/resin pattern required at the base may be curtailed when the taper in arc length has diminished such that excessive material will be wasted. That layer ply may be continued at a lesser width upwards—and so on. The ends of the continuing plies of fiber/resin 21 in one layer may be butted if subsequent ply joints are staggered such that the ply joints do not fall in the same plane (i.e., lie above one another). The ends may also overlap for continuity of structural values.

Suitable fibers 21 include glass, polyaramid, carbon, or ceramic. The resin 22 may be polyester, vinylester, or one of any number of room temperature curing epoxies for a wet lay-up, or pre-impregnated fibers may be used. Pre-impregnated fiber cloth (for use in "pre-preg" lay-up) is more expensive, but because it is "tacky" and not "runny," and will not set-up (cure) until it is exposed to a prescribed temperature, the molding process becomes less delicate without the fluid resin required by a wet lay-up process. The additional time made available by pre-preg lay-up therefore allows for greater control over uniformity among the segments' thickness and contour shape.

Thus molded, the resin matrix 22 can be hardened by any of a variety of well-known cure processes, including vacuum bagging, pressing, autoclaving, heat curing, open curing, or any combination thereof. The resin/fiber is preferably debulked and confined by vacuum bagging.

Most fibers 21—typically 90%—in the external segments 2 of the preferred embodiment of FIG. 1 are desirably oriented parallel to the axis 34 of the pole. For higher stressed poles, however, hoop strength may be increased in the bottom portion of the external structure 13 by molding thicker external segments 2 and/or rotating fibers 21 relative to the pole axis to increase the circumferential mechanical properties. In the latter process each fiber layer 21 added toward the outer face 11 of an external segment 2 is alternately rotated + or − at incremental angular increases until the outermost layers near the bottom 29 are oriented approximately + or −45° to the pole axis.

A single mold comprising one of the two toolings 7, 8 may be utilized to create external segments 2 of several different classes simply by choosing a particular length of a tooling 7, 8 to fill with fiber/resin material. For example, FIG. 5 illustrates the female tooling 8 used to mold the outer face 11 of a tapered external segment 2. Assuming that the tooling 8 is one hundred feet long, it may nevertheless be used to mold a seventy foot external segment 2. The manufacturer need only fill seventy feet of the tooling 8 with fiber/resin material.

The same length of molded external segment 2 may also provide different levels of reinforcement. If only light reinforcement is required, the manufacturer may start laying fiber/resin at the narrow top 28 of the tooling 8 and stop at a point seventy feet from the top 28, represented by the phantom line of FIG. 5 referenced by the numeral 35. If heavier reinforcement is required, the manufacturer may start laying fiber/resin at the wider bottom end 27 of the tooling 8 and stop at a point seventy feet from the bottom 27, represented by the phantom line of FIG. 5 referenced by the numeral 36. It will be understood that intermediate thicknesses and widths of external segments 2 may also be produced by beginning and ending fiber/resin lay-up at various points along the tooling.

Of course, all of the segments produced by the tooling 8 illustrated in FIG. 5 will have the same, constant rate of taper in arc length along the length of the segment. However, toolings with alternative gradings may be appropriate, depending upon end use, without departing from the spirit of the present structural utility pole. Grading of the external reinforcing structure 13 need not be a uniform taper, for example, if the stresses experienced by a utility pole do not vary uniformly along its length.

The amount and type of reinforcement also can be varied by providing multilayered external segments, rather than the single layer described to this point. The following describes several additional embodiments which employ multilayered external segments. Where appropriate, like numbers with letter suffixes have been used to indicate like parts of the different embodiments, for ease of understanding.

Figure 7:
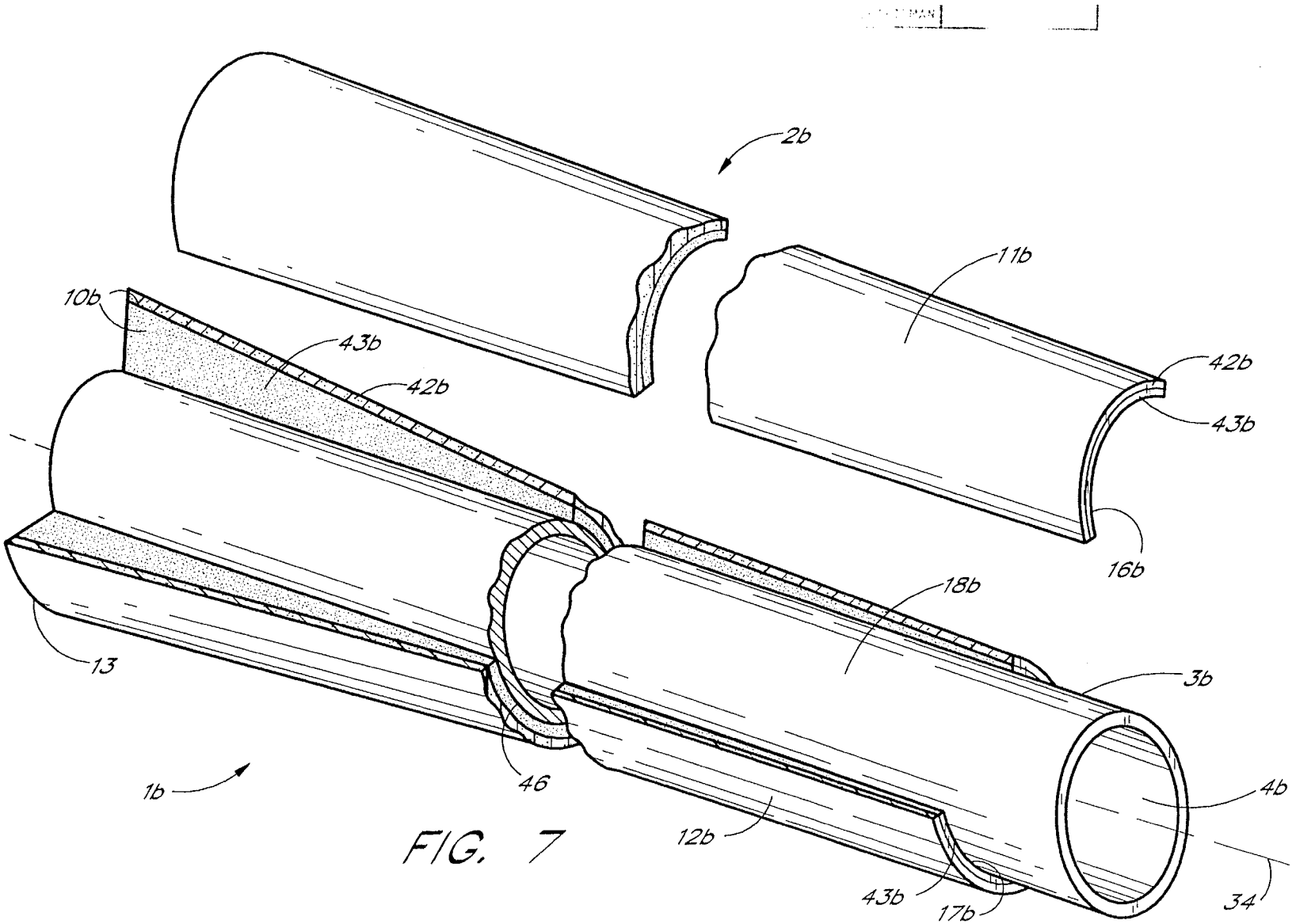
FIG. 7 is a partially exploded perspective view of a graded structural utility pole in accordance with an additional embodiment of the present invention, illustrating bilayered external segments.

FIG. 7 illustrates a structural utility pole **1*b* constructed according to an additional embodiment of the present invention. The pole 16 is substantially identical to the above embodiment, except for the configuration of the external segments 26 which are bilayered. Each bilayered external segment 26 includes an outer skin 42*b* and an inner filler layer 43*b*. The outer skin 42*b* comprises fiber/resin with primarily axial fibers. This outer skin 42*b* covers the filler layer 43*b***, which preferably comprises a rigid foam that provides lightweight stiffness.

Grading may be accomplished by a combination of, for example, grading the filler layer **43*b* and grading outer skin 42*b*, depending on structural needs. FIG. 7 shows most of the tapering to occur in the filler layer. Additionally, when bilayered external segments 2*b* are assembled with an internal member 3*b*, the foam filler 43*b* reacts to compression and laminar shear loading between the outer skin 42*b* and the inner member 3*b*. Note, however, that a pole 1*b* constructed of bilayered external segments 2*b* need not include an internal member 3. By way of contrast, a single layer of fiber/resin reinforcement, as illustrated by FIGS. 1 to 4**, provides maximal strength with minimal stiffness.

Figure 8:
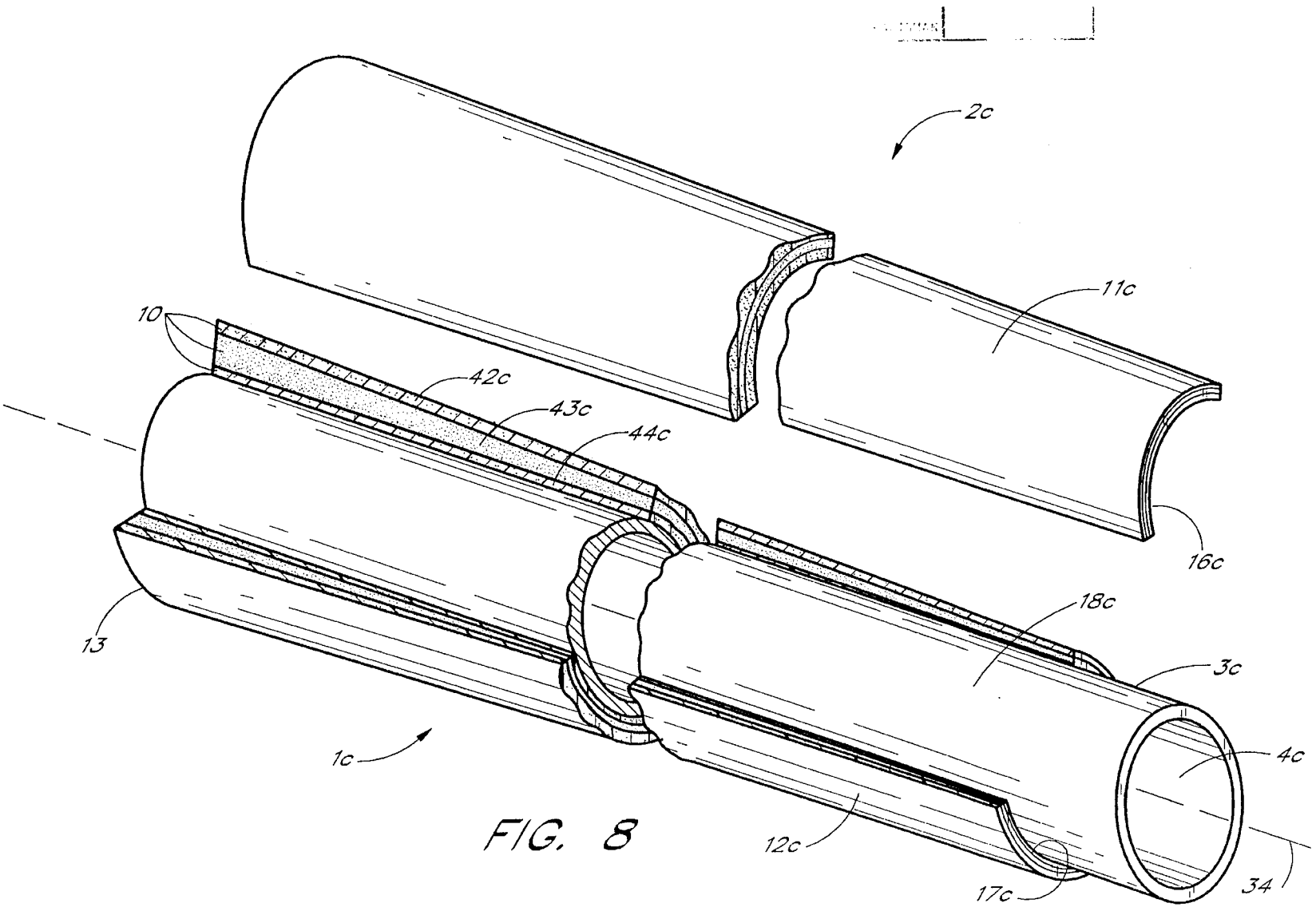
FIG. 8 is a partially exploded perspective view of a graded structural utility pole in accordance with a further preferred embodiment of the present invention, illustrating trilayered external segments.

FIG. 8 illustrates a structural utility pole **1*c* constructed according to a further preferred embodiment of the present invention. This pole 1*c* includes trilayered external segments 2*c*. These segments 2*c* each include the outer skin 42*c* and filler 43*c* of the bilayered segment 2*b* in addition to a third layer: an inner skin 44*c* comprised of fibers with circumferential components. Preferably the fibers have 50% axial orientation and 50% circumferential, enhancing hoop strength in response to radial loading, which increases exponentially as the diameter of the pole 1*c* increases. The inner skin 44*c*** essentially performs the same function as the rotated layers of fiber discussed above. It should be understood that the percentage distribution of axially and circumferentially oriented fibers may vary depending upon the required properties of the finished product.

For either of the multilayered embodiments described, the rigid layer of filler **43*b*, 43*c* may be pre-shaped, either by carving blocks of foam or similar material or by injecting foam into a closed mold. Short sections of foam (not shown) may be used because they will be bonded to at least one one-piece molded skin 42*b*, 42*c*, 44*c*. The fiber/resin laid about both sides of the foam is cured in a mold, producing a smooth outer face 11***b*, 11*c* or inner face 16*c* of the external segment 2*b*, 2*c*, depending upon whether a male or a female mold is employed.

Having created external segments and internal members independently of one another, the manufacturer may then assemble the pole in house or ship the modules to an end user for on-site assembly. The following discussion describes the assembly with reference to only a few different versions of the present structural utility pole. Those skilled in the art, however, will readily appreciate that similar methods may be used to assemble any modification of the present invention from various components.

Referring to FIG. 3, the manufacturer or end user can assemble a pole 1 by simply resin-bonding the inner face 16 of each external segment 2 to the outer surface 18 of the internal member 3, while simultaneously resin-bonding the side faces 10 of the external segments 2 to one another. The bonding resin 46 is preferably an epoxy with high viscosity which will fill any gaps between the components and hold the components together. Before applying the bonding resin 46, the mating surfaces 10, 16, 18 may be prepared by wash, abrading, peel ply or other processes specified by resin 46 suppliers. The joints of the side faces 10 form seams 33 which are visible on the pole's outer surface When the bonding resin 46 is applied, the external segments 2 are preferably held together around the internal member 3 by means of banding (not shown) until the resin the cures. The bands may or may not be removed thereafter. circumferential wrapping with a reinforcing fabric (not shown), such as aramid (e.g,, Kevlar®) or glass, may further secure the assembly 1. At the same time, such a wrap provides a layer of protection against impact damage, especially at the lower end of poles subject to frequent contact with vehicles.

This method of assembly allows the creation of fiber/resin poles which are much longer than previously possible. For example, it is now possible to construct fiber/resin utility poles at heights of 80 to 120 feet or greater, which is adequate for electrical power transmission. Because the external segments 2 are independently pre-molded and cured in mold, rather than created on top of the internal member, there is no worry about deflection while the matrix resin 22 cures. Bonding resin 46 may be applied while the entire assembly is supported horizontally so that deflection is not a concern while curing the bonding resin 46.

The simplicity of assembly allows manufacturer and end users alike to assemble poles on-site, without expensive equipment, from inventoried modules (i.e., the external segments and internal members). On-site assembly has two major advantages made possible by the present structural pole. Although the assembled segmented pole herein described is certainly lighter than prior metal and concrete poles of comparable length, the individual components are lighter still and may be transported even more easily than the entire pole. Furthermore, as will be described below, the components may be shorter than the entire pole, further facilitating transport and storage.

Another advantage of on-site assembly follows from the modular nature of the present structural utility pole. The end user may assemble a pole from a choice of various external segments 2 and internal members 3 with different lengths and structural characteristics, depending upon the user's structural needs. This modular design in fact allows both the manufacturer and the end user to maintain a relatively small inventory of modules (external segments and internal members) and yet have the ability to quickly produce a wide variety of structural utility poles with various characteristics. This modularity is especially advantageous for end users faced with unexpected needs, such as a utility company whose poles have suddenly been lost to a storm. Tailored replacement poles can be quickly created by end users themselves, who need not wait for manufacturers to build to specification and ship.

By way of contrast, utility companies presently specify approximately 10 strength classes and 20 lengths of poles. Without the modular capabilities of the present structural pole, a manufacturer or user would need to maintain an inventory of about 200 different types of bulky poles in order to meet unplanned demand. With the present system, a manufacturer may provide a few different types of external segments, with differing length, thickness, rate of grading/taper, inner and outer cross-sectional circumference, number of layers and fiber orientation. These segments may be designed to approximate the strength classes specified by utility companies. Combined with different lengths of internal members (which may be produced long and cut down to size on site), a total of perhaps less than 30 different types of modules could be mixed and matched to provide the same variety of 200 prior poles, and those modules are less bulky and therefore more easily stored.

A simplified example of the modularity of the present pole design may be useful in illustrating how a relatively small number of modules (i.e., pole components 2,3) can produce poles satisfying a greater number of strength and length classes. A brief explanation of transmission pole classification, however, will first be necessary in order to appreciate the modularity of the present pole design.

Transmission poles conventionally are classified by minimum horizontal loading at the top of the pole. The following is a partial list of actual strength class data taken from tables of end-user specifications:

| Class | Horizontal Load (lbs.) |
|---|---|
| H4 | 8,700 |
| H3 | 7,500 |
| H2 | 6,500 |
| H1 | 5,400 |
| 1 | 4,500 |
| 2 | 3,700 |

In addition to strength classes, users specify pole lengths at 5-foot increments. Multiplying the minimum loading by the distance to the ground gives the moments experienced at the base of the pole, in units of foot pounds (ft.lbs.). The example below will simplify calculations by ignoring burial depth.

For simplicity, the only modules utilized in the following example are one set of trilayered external segments 2, which are 55 feet long, a 75 foot thick-walled inner tube 3, and a 75 foot thin-walled inner tube 3. Combining the external segments 2 with the thick-walled inner tube 3, the resulting pole has a ground level strength of about 480,000 ft.lbs., while a pole with a thin-walled inner tube can resist 360,000 ft.lbs. It is understood that one skilled in the art can determine through standard engineering calculations how thick the inner tubes need to be to create poles of the desired ground level strengths. By cutting a 75 foot inner tube to the desired length and assembling the external segments about the inner tube, poles of a number of different lengths can be easily created.

| Pole Length | Class | Loading Specifications (lbs.) | Moment (1,000 Ft. lb.) | Thick Tube | Thin Tube | Max. Allowed Moment (1,000 Ft. lb.) | Addl. Safety Factor |
|---|---|---|---|---|---|---|---|
| 55 ft. | H4 | 6,700 | 479 | x | | 480 | 0.00 |
| | H3 | 7,500 | 412 | x | | 400 | .16 |
| | H2 | 6,400 | 352 | | x | 360 | .02 |
| | H1 | 5,400 | 297 | | x | 360 | .21 |
| | 1 | 4,500 | 248 | | x | 360 | .45 |
| 60 ft. | H3 | 7,500 | 450 | x | | 480 | .07 |
| | H2 | 6,400 | 384 | x | | 480 | .25 |
| | H1 | 3,400 | 324 | | x | 360 | .11 |
| | 1 | 4,900 | 270 | | x | 360 | .33 |
| 65 ft. | H2 | 6,400 | 416 | x | | 480 | .15 |
| | H1 | 5,400 | 351 | | x | 360 | .03 |
| | 1 | 4,500 | 293 | | x | 360 | .23 |
| | 2 | 3,700 | 241 | | x | 360 | .49 |
| 70 ft. | H2 | 6,400 | 448 | x | | 480 | .07 |
| | H1 | 5,400 | 378 | x | | 480 | .27 |
| | 1 | 4,500 | 315 | | x | 360 | .14 |
| | 2 | 3,700 | 259 | | x | 360 | .39 |
| 75 ft. | H2 | 6,400 | 480 | x | | 420 | 0.00 |
| | H1 | 5,400 | 405 | x | | 480 | .19 |
| | 1 | 4,300 | 338 | | x | 360 | .07 |
| | 2 | 3,700 | 278 | | x | 360 | .27 |

The "Additional Safety Factor" in the above table indicates the percentage by which the pole exceeds the minimum strength required by the class specification. A factor of 0.50 was selected arbitrarily as the limit beyond which the pole is over-designed, that is, too expensive for its intended use. Over-designed poles also are heavier than they need to be, creating unnecessary difficulties in transport and storage. A user may adjust this factor according to need and resources, such that a few components may satisfy an even greater number of strength/length specifications if the user values flexibility over savings.

The example above is of course greatly simplified. Poles over 75 feet tall may require longer external segments for reinforcement. The thickness of the external segments may vary, and the segments may be trilayered, bilayered, or single layered. Different cross-sectional geometries may be better suited to certain end uses, although particular users may find it desirable to maintain a standard inner tube shape and diameter in order to facilitate modular combinations.

Furthermore, internal members may vary in more ways than length alone. Fiber reinforcement, shape and the number of internal members per pole can all be varied, as will be described in detail below. The placement of an inner tube may be varied relative to the external structure; it may attach near the top of the external segment, extending to allow for the attachment of cross-members suited to carrying electrical cables. Thus, a relatively small inventory of modules has the capability of producing a great variety of poles with differing structural characteristics, reducing both production lead time and storage space.

The above discussion also makes clear that the strength grading along the length of the pole can be achieved through at least three different approaches or a combination of two or more these approaches. The width or diameter of the pole can taper along its length to increases the strength of the pole toward its base. The orientation of the fibers of the composite layers of the external segments 2 and/or the internal member 3 can be skewed relative to the pole axis, especially toward the base of the pole. The composite layers can also be hyberdized to give the pole varying strength and stiffness along its length. That is, different layers, or even the same layer, can be made of different materials, such as, for example, different types of fibers. One or more of these approaches provides a pole with graded structural strength.

As mentioned, a variety of internal members may be employed in different embodiments of the current structural pole, contributing to the diversity of poles which may be produced from relatively few modules. In discussing the variety of internal members, reference will be made to FIGS. 9 and 10, in which particular external segments are illustrated. It will be understood, though, that the various internal members described may equally well be combined with any of the other types of external segments described, depending upon the structural characteristics desired, such as particular strength, stiffness, or weight.

Figure 9:
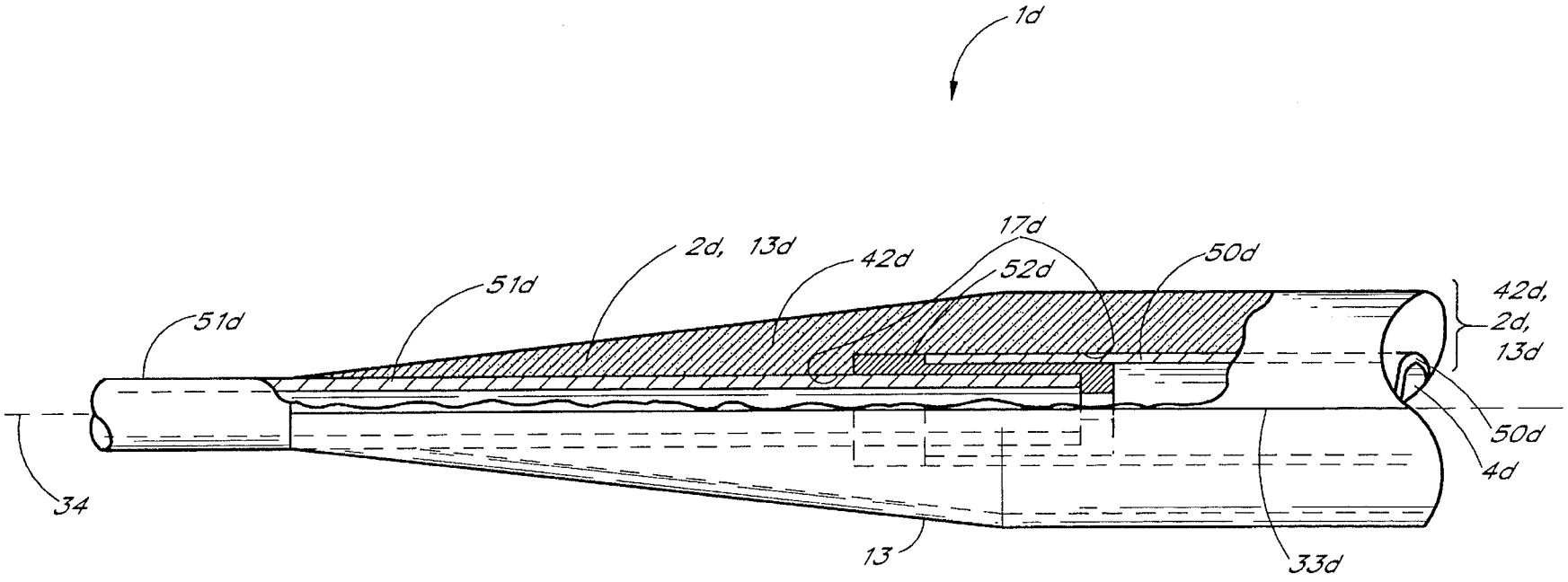
FIG. 9 is a partial sectional side elevational view of a graded structural utility pole in accordance with another preferred embodiment of the present invention, illustrating two internal members joined by a common external structure.

Multiple internal members may be joined together within a single pole. FIG. 9 illustrates a partial sectional view of another embodiment of the present invention, in which a large internal member 50*d* and a small internal member 51*d* are held together by a common external structure 13*d*. The telescoping internal members 50*d*, 51*d* aid in producing a greater taper rate without extremely thick and heavy external segments 2*d*. For this embodiment, of course, the external segments 2*d* would need to be molded such that their inner faces 16*d* step down to match the step in diameter from the large internal member 50*d* to the small internal member 51*d*.

The two internal members 50*d*, 51*d* may be bonded to the inner faces 16*d* of the external sections 2*d* at the outer surfaces (not visible in FIG. 10) of the internal members 50*d*, 51*d*. The joint of the two sections essentially comprises the entire bonded interface between the external structure 13*d* and the internal members 50*d*, 51*d*. With the bond occurring over a far larger surface area than butt joints of welded metal poles, for example, a much stronger joint results.

Alternatively, only the larger internal member 50*d* may be bonded to the bottom portion of the external structure 13*d*, while the smaller section 51*d* can be removably inserted into the sleeve joint created by the extension of the external structure 13*d* beyond larger internal member 50*d*. In this fashion the telescoping pole 1*e* may be partially dissembled when not in use and stored more easily.

If the removability feature is combined with telescoping internal members 50*d*, 51*d* which are hollow tubes, a stopping mechanism, such as a tab, is required to keep the small internal member 51*d* from slipping into the large internal member 50*d*. The pole 1*d* of FIG. 9 includes a reducer/adapter 52*d* which serves this function.

A similar joint mechanism may be used to join shorter sections of the same diameter, again for easier transport and storage. For such a pole (not shown), neither step down inner faces nor stopping mechanisms are required so that the external segments may resemble those of FIGS. 1 to 3, with a constant-section inner surface 17 of the external structure 13. However, without the step down in diameter, the external segments would not be as lightweight as the external segments 2*d* of FIG. 9.

Figure 10:
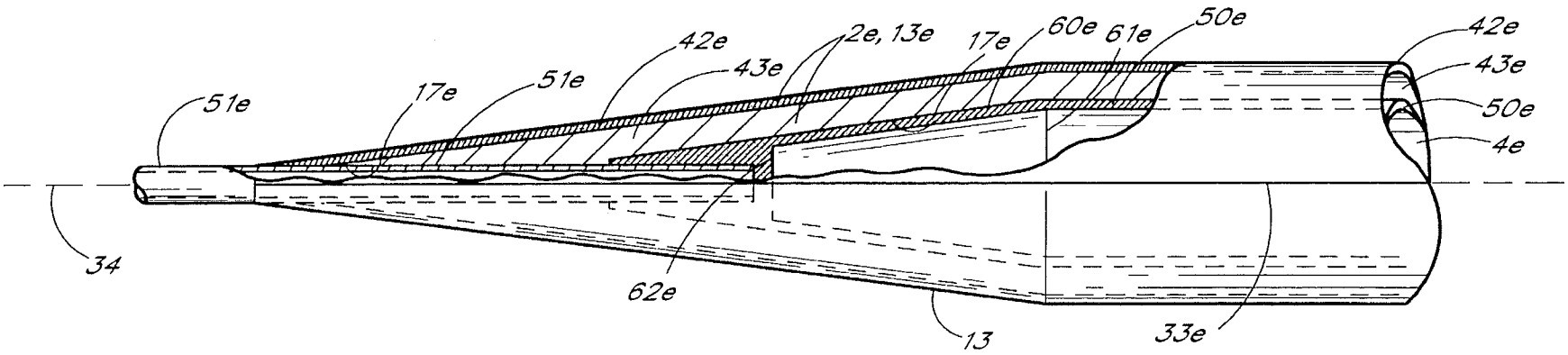
FIG. 10 is a partial sectional side elevational view of a graded structural utility pole in accordance with an additional preferred embodiment of the present invention, illustrating a tapered internal member and a smaller member joined by a common external structure.

As illustrated by FIG. 10, external tapering may be even further simplified by use of a tapered internal member 60*e*. As has been noted, tapered poles produced by prior methods—such as filament winding—are limited in length. However, the present invention allows shorter lengths of internal members to be combined end-to-end and externally reinforced. FIG. 11 shows an embodiment in which a large internal member 50*e* is connected to a wider end 61*e* of the tapered internal member 60*e*, which is in turn connected at a tapered end 62*e* to a small internal member 51*e*. Thus, although the tapered internal member 60*e* may be relatively short, the entire pole 1*e* may be long enough for electrical transmission. Shorter internal members are also easier to transport and store than are whole poles.

Further variety is provided by varying the total length of the internal member(s) relative to the external structure. The internal member 3 of FIGS. 1 to 3 and is shown extending beyond the external structure 13. Such a configuration is especially relevant to applications which require only a light standard, such as a lamppost, rather than a heavy load-bearing structural pole. Alternatively, the external segments 2 may extend the length of the pole for applications requiring stronger or stiffer support. It will be understood that different relative lengths of the modules may equally well be produced for all embodiments of the present invention.

On the other hand, the pole may not include any internal members at all. As previously noted, FIG. 11 illustrates an embodiment of the present invention, comprising only external segments 2*a* bonded at their side faces 10*a* with no internal member. The external segments 2*a* could still have all the variation described above, including bilayered and trilayered construction, varied taper rates, and varied lengths.

It is preferred that the pole 1*a* include a hollow core 4*a* to maintain a lightweight design. In order to ease alignment of the external segments with one another for bonding, it may be necessary to employ a ring, disc, or even cardboard cylinder (not shown), with diameter matching the inner surface 10*a* of the external structure 13*a*. Such an alignment ring may or may not be removed after the bonding resin 46*a* has been cured. Even if it remains it would not contribute significantly to either the weight or the strength of the pole 1*a*, other than to prevent inward collapse.

It should be readily apparent that the described embodiments of the invention provide an effective structural utility pole, wherein independent, vertically oriented segments are pre-molded and assembled to produce a modular fiber/resin composite pole. Though directed to specific application as a utility pole, those skilled in the art will appreciate that the pole can easily be adapted for other uses, wherein the strength of the pole may be graded from its center toward its ends, rather than from one end to the other. Furthermore, the foregoing description is of preferred embodiments of the invention, and various changes and modifications may be made without departing from the spirit and scope of the invention, as defined by the appended claims.

What is claimed is:

1. A structural pole for supporting utility lines comprising a plurality of elongated external segments, each external segment comprising two side faces and an outer face and having a thickness which varies along the length of said external segment, each external segment comprising a fiber-resin composite material, said external segments being attached to one another along said side faces and cooperating with one another to form an external structure with a thickness varying along the length of the external structure, each external segment extending the length of said external structure with said outer faces of said external segments cooperating to form an outer surface of said external structure, said external structure extending along an axis of said pole with at least a portion of said outer surface of said external structure extending about said axis of said pole.

2. The structural pole of claim 1, wherein each said external segment also includes an inner face, said inner faces of said external segments cooperating with one another to form an inner surface of said external structure.

3. The structural pole of claim 2, wherein said external segments uniformly taper in thickness so that said external structure has a thickness which gradually increases from a top end to a bottom end of greater thickness.

4. The structural pole of claim 3, wherein said outer surface of said external structure generally has a frusto-conical shape.

5. The structural pole of claim 2, wherein said inner surface of said external structure has a uniform cross section.

6. The structural pole of claim 5, wherein said inner surface of said external structure has a cylindrical shape positioned about said axis of said pole.

7. The structural pole of claim 2 additionally comprising at least one internal member having an outer surface, said outer surface of said internal member attached to said inner faces of said external segments.

8. The structural pole of claim 7, wherein said internal member is resin-bonded flush to said inner faces of said external segments, and said side faces of said external segments are resin-bonded to one another.

9. The structural pole of claim 7, wherein said internal member comprises a hollow fiber-resin tube.

10. The structural pole of claim 7, wherein said outer surface of said internal member tapers in diameter along at least a portion of its length.

11. The structural pole of claim 2 additionally comprising first and second internal members each having an outer surface, said first internal member having a larger diameter than said second internal member, said inner faces of said external segments being attached to said outer surface of said first internal member proximate to a lower end of said external structure, and said inner faces of said external segments being attached to said outer surface of said second internal member proximate to an upper end of said external structure, said bottom end of said external structure having a larger diameter than said bottom end.

12. The structural pole of claim 11, wherein said second internal member extends beyond said upper end of said external structure.

13. The structural pole of claim 11, wherein said inner surface of said external structure comprises a narrow diameter portion, matching and attached flush to said second internal member, and a wide diameter portion, matching and attached flush to said first internal member.

14. The structural pole of claim 1, wherein each external segment includes an outer skin comprising a bonding agent hardened around reinforcing fibers.

15. The structural pole of claim 14, wherein said bonding agent comprises a resin selected from the group consisting of polyester, vinylester, and epoxy.

16. The structural pole of claim 14, wherein said fibers comprise material selected from the group consisting of glass, aramid, carbon, and ceramic.

17. The structural pole of claim 14, wherein each external segment additionally comprises an interior layer of filler attached to said outer skin.

18. The structural pole of claim 17, wherein each external segment additionally comprises an inner skin laid over said layer of filler so as to interpose said layer of filler between said inner and outer skins, said inner skin forming an inner face of said external segment.

19. The structural pole of claim 18, wherein said inner skin comprises resin hardened around reinforcing fibers.

20. The structural pole of claim 19, wherein approximately 50% of said fibers of said inner skin are skewed relative to the axis of said pole.

21. A structural pole for supporting utility lines comprising an internal member having a vertical axis and a plurality of external segments each comprising fiber-resin composite material, said external segments being attached to one another to form a reinforcing external structure which is attached to and surrounds at least a portion of said internal member to form said structural pole, said external segments being independent of said internal member, each external segment having an outer face and an inner face which is configured to mate with a portion of said internal member, said external segment having a thickness defined between said inner and outer faces which varies along the length of said external segment.

22. The structural pole of claim 21, wherein said external segments generally form a tapered cylindrical sheath over said internal member.

23. The structural pole of claim 21, wherein said external segments are oriented generally parallel to said vertical axis of said pole with said external segments all having the same length.

24. The structural pole of claim 21, wherein said internal member comprises a fiber-resin composite.

25. The structural pole of claim 21, wherein said internal member defines the length of said pole with said external segments have a length not greater than the length of said internal member.

26. The structural pole of claim 21, wherein said external segments have a longer length than said internal member.

27. The structural pole of claim 21, wherein said external segments include at least one skin formed of a fiber-resin composite with at least a portion of the fibers having a skewed orientation relative to the axis of the pole.

28. The structural pole of claim 21, wherein said external segments comprise a hyberdized fiber-resin composite.

29. The structural pole of claim 21, wherein said internal member comprises a first fiber-resin composite and each of said external segments comprises a second fiber-resin composite, said first fiber-resin composite having a different type of fibers than said second fiber-resin composite.

30. The structural pole of claim 1, wherein said external segments have identical shapes.

31. The structure pole of claim 2 wherein said inner face of each external segment has a generally concave shape and said outer face of each external segment has a generally convex shape.

32. The structural pole of claim 7, wherein the outer surface of said internal member generally has a uniform diameter along the entire length of said internal member.

33. The structural pole of claim 21 wherein each external segment includes at least two side surfaces, each side surface being configured to cooperate with a side surface of an adjacent external segment.

34. The structural pole of claim 21 wherein said inner face of each external segment generally has a concave shape and said outer face of each external segment generally has a convex shape.

35. The structural pole of claim 21, wherein the external segments generally have identical cross-sectional shapes.

36. A structural pole comprising a plurality of identically shaped segments, each segment comprising a fiber-resin composite material and having a cross-sectional shape defined by a concave inner surface and a convex outer surface flanked by a pair of side surfaces, each side surface being configured to cooperate with a side surface of an adjacent segment, said segments being attached to one another along said side surfaces and cooperating with one another to form at least a structural portion of said pole with the outer surfaces of said segments cooperating to form an outer surface of said structural portion, each segment having a thickness defined by the outer and inner surfaces which varies along the length of said segment.

37. The structural pole of claim 36, wherein the structural portion defined by the segments have a cross sectional diameter which varies along the length of the structure.

38. The structural pole of claim 36, wherein each segment includes an outer skin comprising a bonding agent hardened around reinforcing fibers.

39. The structural pole of claim 38, wherein each segment additionally comprises an inner layer of filler attached to said outer skin.

40. The structural pole of claim 39, wherein each segment additionally comprises an inner skin laid over the layer of filler so as to interpose the layer of filler between said inner and outer skins, said inner skin forming said inner concave face of said segment.

41. The structural pole of claim 36, additionally comprising an inner cylindrical member which is configured to fit within the space defined by the cooperating inner faces of said segments.

42. The structural pole of claim 41, wherein said inner member has a uniform diameter along its length.

43. The structural pole of claim 41, wherein said inner member has a length longer than the lengths of said segments.

44. A structural pole comprising a plurality of elongated segments, each segment comprising two side faces and an outer face, said segments being attached to one another along said side faces and cooperating with one another to form a structural portion of said structural pole, said structural portion having a thickness varying along the length of said structural portion, each segment extending the length of the structural portion with the outer faces of the external segments cooperating to form an outer face of the structural portion, said structural portion extending along an axis of said pole with at least a portion of the outer surface of the structural portion extending about said axis of said pole.

* * * * *

UNITED STATES PATENT AND TRADEMARK OFFICE

CERTIFICATE OF CORRECTION

PATENT NO. : 5,513,477
DATED : May 7, 1996
INVENTOR(S) : Milton L. Farber

It is certified that error appears in the above-identified patent and that said Letters Patent is hereby corrected as shown below:

Columns 11 and 12 - in the table:
Line 5, Table Column 3 - please replace -- 6,700 -- with -- 8,700 --
Line 6, Table Column 4 - please replace -- 412 -- with -- 413 --
Line 6, Table Column 7 - please replace -- 400 -- with -- 480 --
Line 12, Table Column 3 - please replace -- 3,400 -- with --5,400 --
Line 13, Table Column 3 - please replace -- 4,900 -- with -- 4,500 --
Line 22, Table Column 7 - please replace --420 -- with --480 --

Column 15,
Line 65 - replace -- segment has -- with -- segments has --

Signed and Sealed this

Thirty-first Day of July, 2001

*Attest:*

Nicholas P. Godici

*Attesting Officer*

NICHOLAS P. GODICI
*Acting Director of the United States Patent and Trademark Office*